US006237449B1

(12) United States Patent
Orlosky

(10) Patent No.: US 6,237,449 B1
(45) **Date of Patent: *May 29, 2001**

(54) QUICKLY-ADJUSTABLE GRIPPING AND CUTTING TOOLS

(75) Inventor: Henry Orlosky, Cameron Park, CA (US)

(73) Assignee: Tool Research Corporation, El Dorado Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/500,198

(22) Filed: Feb. 7, 2000

Related U.S. Application Data

(63) Continuation-in-part of application No. 08/858,686, filed on May 19, 1997, now Pat. No. 6,026,716.

(51) Int. Cl.[7] ..... B25B 7/12

(52) U.S. Cl. ..... 81/360; 81/322; 30/101

(58) Field of Search ..... 30/101, 96, 102; 81/182, 319, 322, 360

(56) References Cited

U.S. PATENT DOCUMENTS

| | | | | |
|---|---|---|---|---|
| D. 358,746 | | 5/1995 | Neff . | |
| 1,460,294 | * | 6/1923 | Wegner | 81/182 X |
| 3,283,624 | | 11/1966 | Neff . | |
| 5,005,449 | * | 4/1991 | Sorensen et al. | 81/182 X |
| 5,176,049 | | 1/1993 | Neff . | |
| 5,385,072 | | 1/1995 | Neff . | |
| 5,408,904 | | 4/1995 | Neff . | |
| 5,581,886 | * | 12/1996 | Sesser et al. | 30/102 |
| 6,026,716 | | 2/2000 | Orlosky . | |

FOREIGN PATENT DOCUMENTS

| | | |
|---|---|---|
| 1094703 | 12/1954 | (FR) . |

* cited by examiner

*Primary Examiner*—James G. Smith
(74) *Attorney, Agent, or Firm*—John P. O'Banion

(57) ABSTRACT

A hand tool that is self-adjusting by alternately squeezing and relaxing the hand grip on the two handles, and that has substantially parallel jaws during closing adjustment. In one embodiment, the jaws have opposing gripping surfaces. In another embodiment, the jaws have opposing cutting blades. All of the operations, except the resetting of the adjustable jaw to a wide open position, can be accomplished with just one hand holding the tool.

20 Claims, 15 Drawing Sheets

QUICKLY-ADJUSTABLE GRIPPING AND CUTTING TOOLS

CROSS-REFERENCE TO RELATED APPLICATIONS

This application is a continuation-in-part of application Ser. No. 08/858,686 filed on May 19, 1997, now U.S. Pat. No. 6,026,716, which is incorporated herein by reference.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to hand tools in general, and more particularly to a tool that firmly grips a work object, is adjustable, can be locked on the work object easily and quickly, and can be released from the locked position just as easily and quickly.

2. Description of the Background Art

This invention is an improvement over the hand tool described in U.S. Pat. No. 5,408,904 issued on Apr. 25, 1995 "QUICK-ADJUSTABLE AND LOCKING TOOL", incorporated herein by reference, and the hand tool described in U.S. Pat. No. 5,176,049 issued on Jan. 5, 1993 "COMPOUND LEVERAGE GRIPPING TOOL WITH CONSTANT PARALLEL JAWS", also incorporated herein by reference, both of which are owned by the assignee hereof.

BRIEF SUMMARY OF THE INVENTION

The present invention generally comprises a hand-held tool for firmly gripping or advancing a cutting blade on a work object, that is adjustable, that can grip or engage a cutting blade on a work object easily and quickly, and can be released from the gripping or cutting position just as easily and quickly. By way of example, and not of limitation, the invention comprises a body with an integral fixed jaw extending from one end and an integral fixed handle extending from the opposite end, a jaw adjusting handle pivotally coupled to the body, and an adjustable jaw slidably and pivotally coupled to the body.

Both the adjustable jaw and the jaw adjusting handle carry gear teeth that are normally maintained in engagement under the tension of a spring. The gear teeth, which are of a conjugate involute design, are positioned such that the gripping surfaces of the jaws are maintained in a substantially parallel orientation when the adjustable jaw moves toward the fixed jaw and, in particular, the gear teeth on the adjustable jaw are positioned along an axis that is canted by approximately one to four degrees in relation to a line perpendicular to the axis along the gripping or cutting surface of the adjustable jaw. As the jaw adjusting handle is pivoted toward the fixed handle, a jacking action quickly adjusts the adjustable jaw toward the fixed jaw for engaging and cutting an object. In order to open the jaws, the user can grasp the lower portion of adjustable jaw and pull it outward from the body to disengage the gears and then away from the fixed jaw in a single motion.

In an embodiment configured for gripping an object, each jaw carries a set of teeth which, instead of directly opposing each other, are laterally offset to reduce the likelihood of the teeth cutting into the object being gripped. Alternative embodiments include jaws with smooth gripping surfaces, jaws with arcuate teeth for gripping cylindrical objects, and jaws with V-shaped gripping surfaces.

In an embodiment configured for cutting an object, the engaging surface of each jaw has an elongate blade which faces the engaging surface and blade of the opposing jaw. The blades are preferably positioned in the same vertical plane such that the blades are brought together as the jaws advance. However, a configuration where the blades are brought together side by side is also contemplated. Yet other embodiment includes a number of cutting discs mounted within the jaws of the tool. The cutting disks engage the surface of a pipe and the tool is revolved around the pipe as the jaws are slowly advanced together.

An object of the invention is to provide a hand-operated tool for gripping or cutting objects that is self-adjusting.

Another object of the invention is to provide a hand-operated tool for gripping or cutting objects that has jaws that maintain substantially parallel alignment while being closed.

Another object of the invention is to provide a hand operated tool for gripping or cutting objects that has a self-adjusting jaw that will close and lock against an object.

Another object of the invention is to provide a hand-operated tool for gripping or cutting objects that has locking jaws that can be easily opened for removal of the tool from an object being gripped or cut.

Still another object of the invention is to provide a hand operated tool with cutters that apply constant force to the cutting surfaces as the jaws close incrementally.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings, which are for illustrative purposes only:

FIG. 15 is an assembled view in side elevation showing an alternative embodiment of the invention in the form of a cutter with an elongate head having jaws with opposing blades with cutting edges disposed within the same vertical plane for cutting leather and the like.

DETAILED DESCRIPTION OF THE INVENTION

Figure 1:
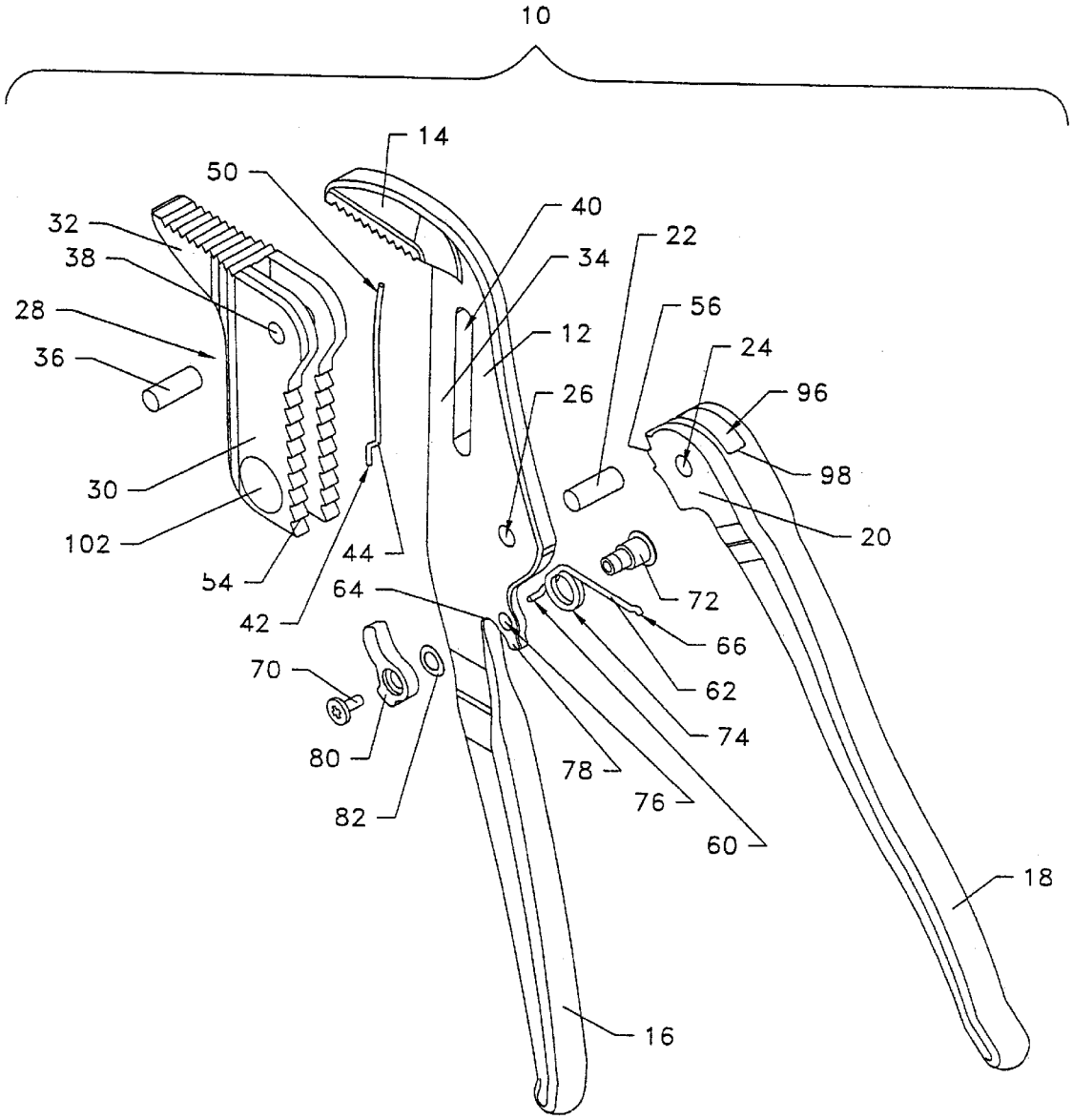
FIG. 1 is an exploded view of an apparatus in accordance with the present invention, shown in the form of a plier having gripping surfaces with serrated teeth.

Referring more specifically to the drawings, for illustrative purposes the present invention is embodied in the apparatus generally shown in FIG. 1 through FIG. 15, where like reference numerals denote like parts. It will be appreciated that the apparatus may vary as to configuration and as to details of the parts without departing from the basic concepts as disclosed herein.

Referring first to FIG. 1, a quickly-adjustable gripping tool 10 in accordance with the present invention is generally shown. The apparatus includes a body 12 with an integral fixed jaw 14 extending from one end, and an integral fixed handle 16 extending from the other end with the longitudinal axis of fixed handle 16 being offset by approximately 0 degrees to 45-degrees from a perpendicular orientation relative to the longitudinal axis of fixed jaw 14.

The apparatus also includes a jaw adjusting handle 18 that is pivotally coupled to body 12. Extending from the distal end of jaw adjusting handle 18 is an integral bifurcated coupling 20 that straddles body 12. A pin 22, or like fastener, extends through holes 24 in the sides of coupling 20 and a hole 26 in body 12 for pivotally coupling jaw adjusting handle 18 to body 12. It will be appreciated that, in the configuration shown, the diameter of hole 26 must be slightly larger than that of pin 22 to allow for free pivotal movement of jaw adjusting handle 18, while holes 24 in coupling 20 must be sized to provide for tight frictional engagement of pin 22.

An adjustable jaw 28 is slidably and pivotally coupled to body 12. Adjustable jaw 28 generally comprises an integral bifurcated coupling section 30 extending from jaw section 32. The bifurcated coupling section 30 straddles a rail section 34 on body 12 and is coupled to body 12 using a pin 36 or like fastener. Pin 36 extends through holes 38 in the side walls of coupling section 30 and an elongated slot 40 in body 12 to allow for both pivotal and sliding motion of adjustable jaw 28. Note that the rail section 34 is substantially perpendicular to fixed jaw 14 and elongated slot 40 is substantially parallel to rail section 34.

Figure 2:
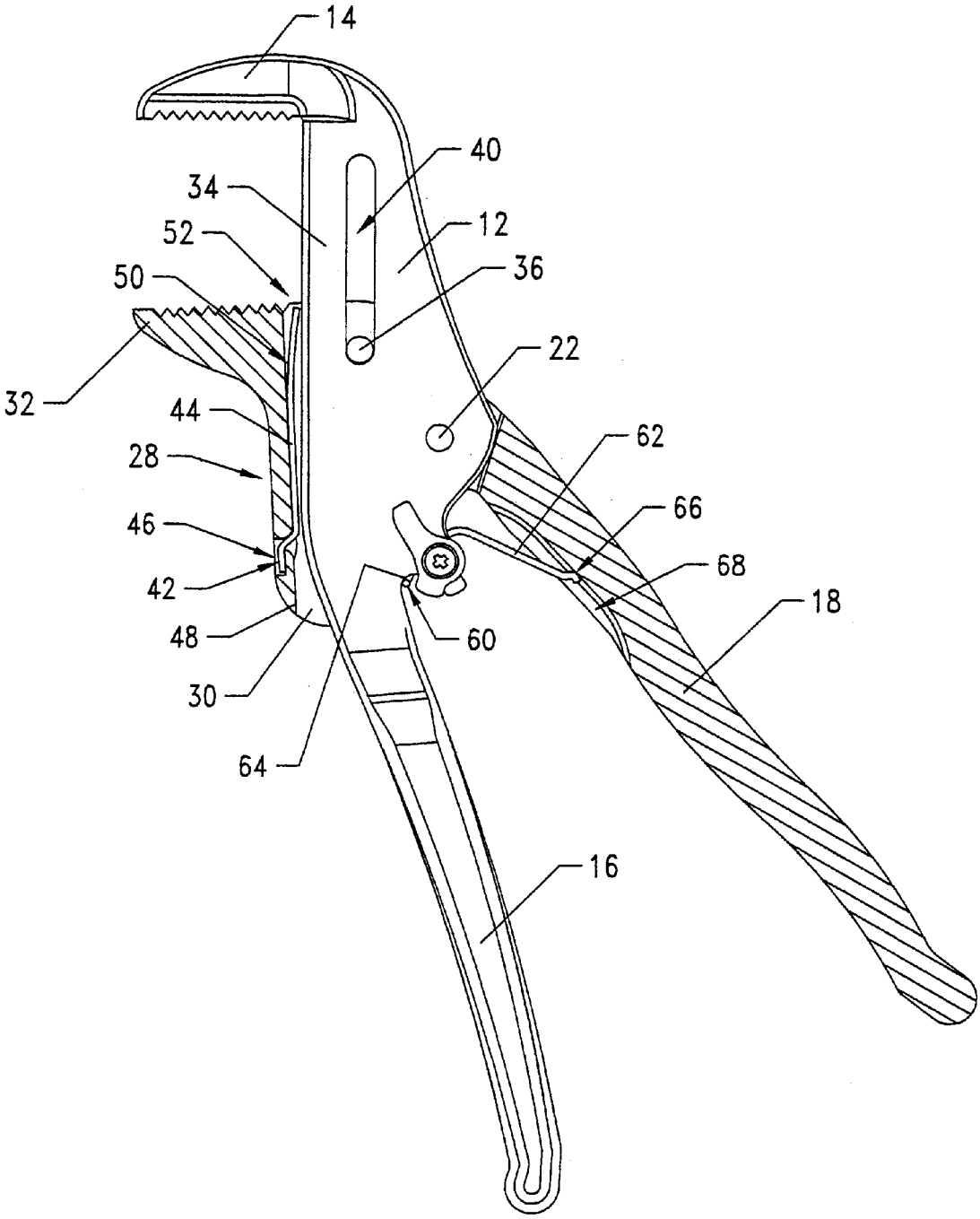
FIG. 2 is assembled side elevation sectional view of the apparatus shown in FIG. 1 with the jaws shown in the fully open position.
Figure 3:
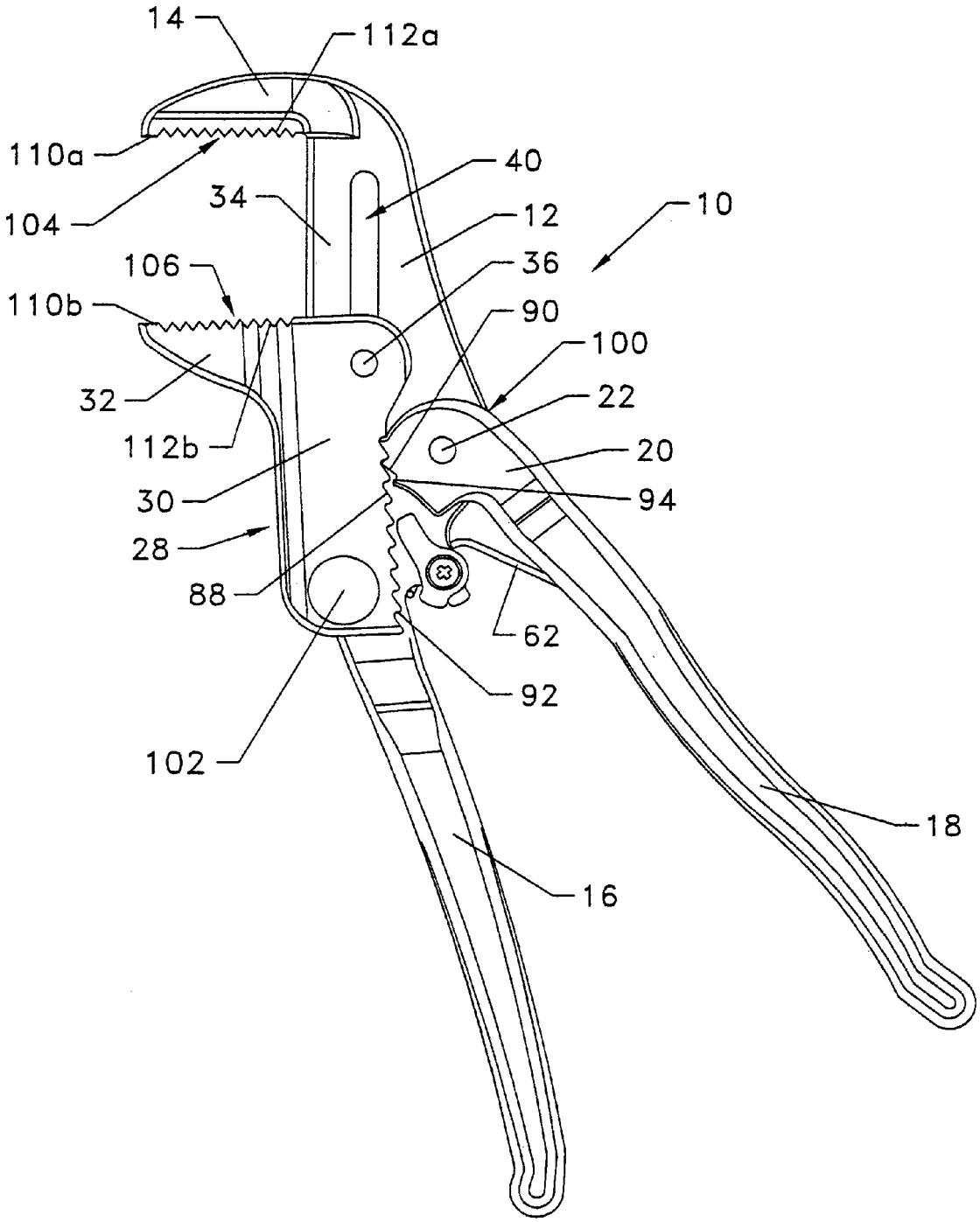
FIG. 3 is an assembled side elevation view of the apparatus shown in FIG. 1 with the jaws shown in the fully open position.
Figure 4:
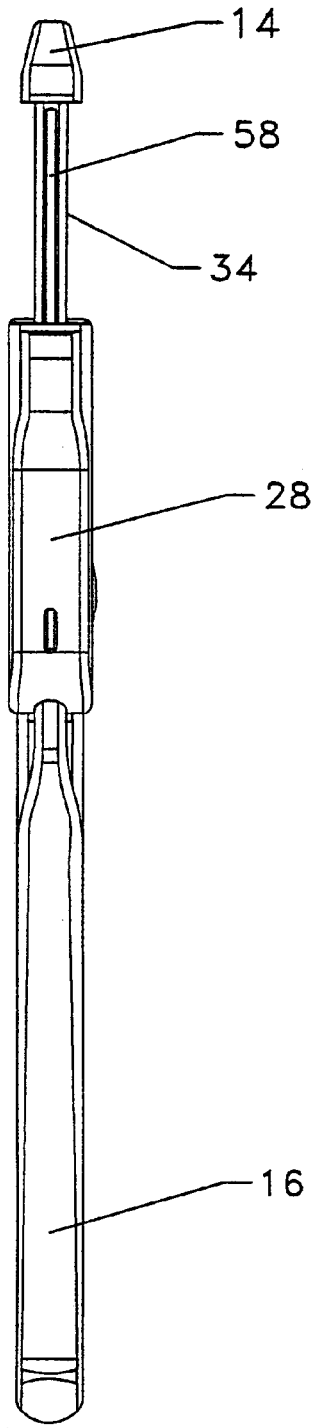
FIG. 4 is an assembled front view of the apparatus shown in FIG. 1 with the jaws shown in the fully open position.

Referring also to FIG. 2, the lower end 42 of a jaw tensioning spring 44 extends into a retention recess 46 in wall 48 of coupling section 30 on adjustable jaw 28. Jaw tensioning spring 44 includes an arcuate upper end 50 that bears forcefully against rail section 34, pushing the upper portion 52 of adjustable jaw 28 away from rail section 34. Referring also to FIG. 3, jaw tensioning spring 44 pushes gear teeth 54 on adjustable jaw 28 toward gear teeth 56 on jaw adjusting handle 18 so that gear teeth are normally engaged. Jaw tensioning spring 44 also holds adjustable jaw member 28 in position by frictional contact with rail section 34 until moved by pivoting motion of jaw adjusting handle 18 or until adjustable jaw 28 is pulled away from rail section 34 for repositioning away from fixed jaw 14 as described below. Referring also to FIG. 4, if desired the upper end 50 of jaw tensioning spring 44 can optionally fit into a central groove 58 in the face of rail section 34 so as to keep jaw tensioning spring 44 centered.

Referring again to FIG. 1 and FIG. 2, a first end 60 of a handle return spring 62 fits into and rests against an inner shoulder 64 between body 12 and fixed handle 16. A second end 66 of handle return spring 62 fits into recess 68 in jaw adjusting handle 18. Handle return spring 62 is also coupled to body 12 using a screw 70 that engages a threaded bushing 72 that extends through coil 74 in handle return spring 62 and hole 76 in yoke 78 that extends from body 12. A handle locking lever 80 and spring washer 82 are also positioned between screw 70 and yoke 78 as shown.

Figure 5:
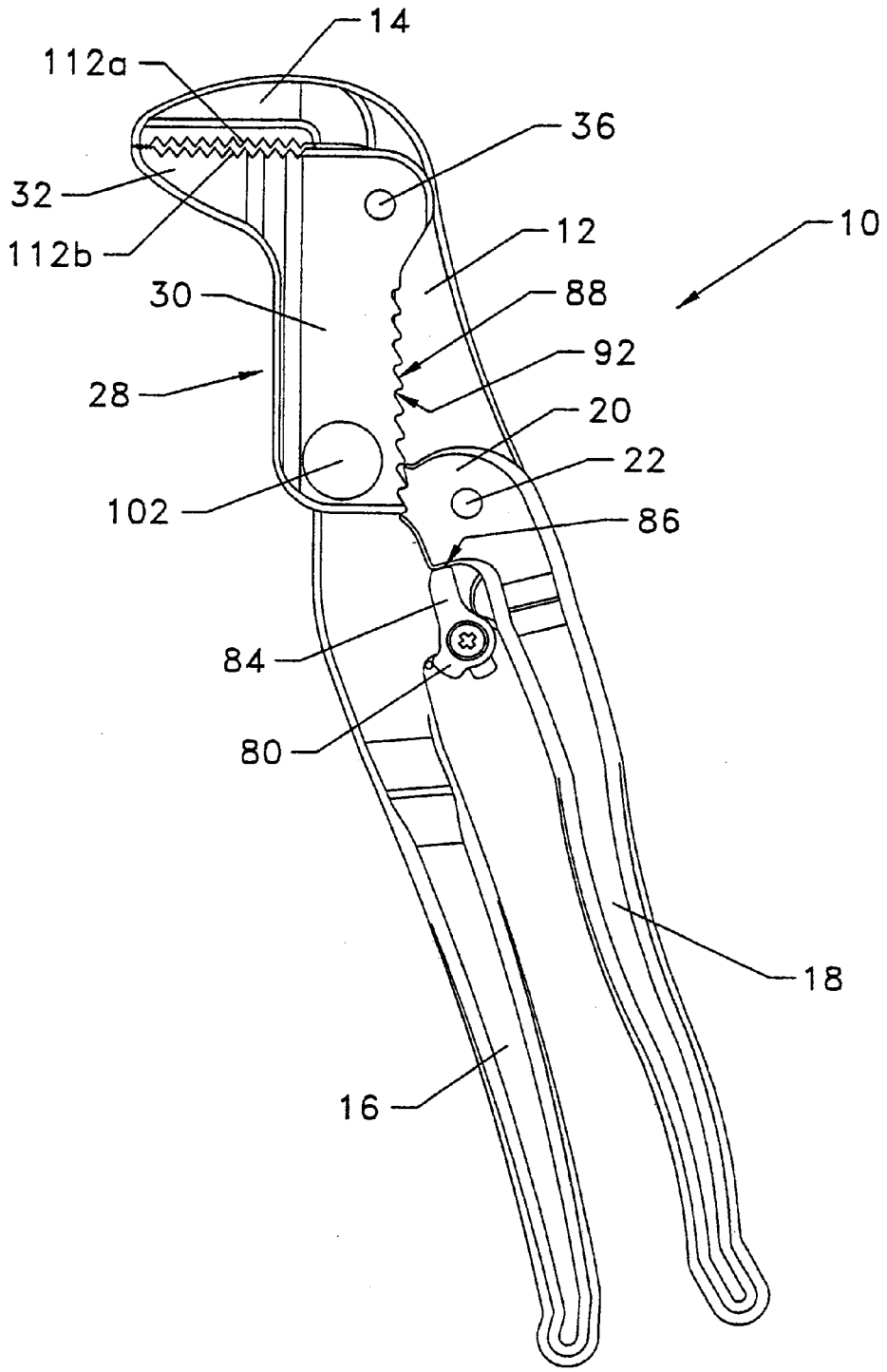
FIG. 5 is an assembled side elevation view of the apparatus shown in FIG. 1 with the jaws shown in the fully closed position and the handles locked.

It will be appreciated that handle locking lever 80 is pivotally coupled to yoke 78 on body 12 as described above. When fixed handle 16 and jaw adjusting handle 18 are in their fully compressed (closed) position as shown in FIG. 5, handle locking lever 80 can be pivoted into a position where a tab 84, that extends from handle locking lever 80, rests against shoulder portion 86 on one side of bifurcated coupling 20. In this position, handle locking lever 80 prevents jaw adjusting handle 18 from pivoting into an open position.

Referring to FIG. 1, FIG. 3 and FIG. 5, a jacking action that quickly adjusts jaw 32 toward jaw 14 is accomplished by the conjugate involute design of gear teeth 54 on adjustable jaw 28 and gear teeth 56 on jaw adjusting handle 18. Both sets of gear teeth have long flat sides 88, 90, and shorter flat sides 92, 94 that join together at radiused edges to form angled teeth. As jaw adjusting handle 18 pivots away from fixed handle 16, the long flat sides 88 on gear teeth 54 slide down the long flat sides 90 and over the radiused edges on gear teeth 56 while adjustable jaw 28 is held substantially stationary by the friction of jaw tensioning spring 44 against rail section 34 until gear teeth 54 and 56 are re-engaged at a lower position on adjustable jaw 28. The pivoting of jaw adjusting handle 18 back toward fixed handle 16 brings short sides 92, 94 into contact and, because of their relatively obtuse angle in relation to rail section 34, they remain engaged until the movement of jaw adjusting handle 18 is again reversed, thereby moving adjustable jaw 28 toward fixed jaw 14 in a series of jacking movements. Repeated pivoting of jaw adjusting handle 18 will close jaws 14 and 32 on an object very quickly in just a few seconds.

Alternatively, adjustable jaw 28 can be grasped by the user and slid toward fixed jaw 14 to initially grip the work object, and jaw adjusting handle 28 then used to tighten the grip. The travel of jaw adjusting handle 18 away from fixed handle 16 is limited by the depth of the bifurcation 96 in coupling 20 which terminates in a shoulder 98 that will abut against the edge 100 of body 12 in the fully opened position. Limiting the degree of rotation of jaw adjusting handle 18 prevents the handle from pulling handle return spring 62 apart and facilitates gripping by ensuring that the handle does not open too wide.

To reset jaw 32 to an open position in relation to fixed jaw 14, concave finger grips 102 are provided on each side of adjustable jaw 28 so that the user can easily grasp the lower portion of adjustable jaw 28 and pull it outward and downward in a single motion. This will result in gear teeth 54 and 56 being disengaged and, while disengaged, adjustable jaw 28 may be set at any point between the top and bottom of its travel within the confines of elongated slot 40 and re-engaged at the option of the user.

Figure 6:
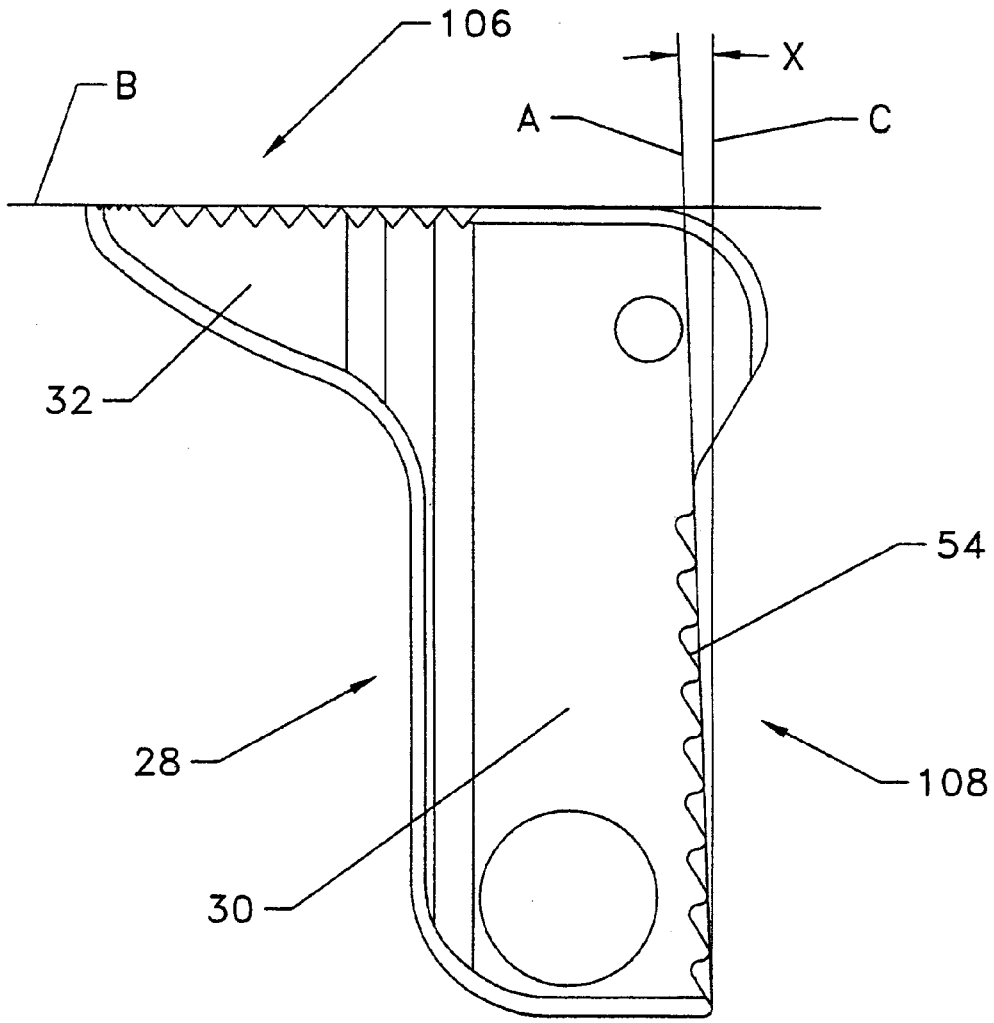
FIG. 6 is a side elevation view of the adjustable jaw portion of the apparatus shown in FIG. 1 illustrating the positional relationship between the gear teeth and the gripping surface of the jaw.

Referring now to FIG. 3 and FIG. 6, it can be seen that jaws 14 and 32 each have longitudinal gripping surfaces 104 and 106, respectively. It is important that, when the jaws are being adjusted toward each other as well as tightened against an object to be gripped, the longitudinal axis along those gripping surfaces are maintained in a substantially parallel orientation. In order to maintain such an orientation while the jaws are being closed and to facilitate a quick closing motion of adjustable jaw 28 from any retracted position, a critical aspect of the invention is the positioning of the conjugate involute gear teeth 54 on adjustable jaw 28. As can be seen from FIG. 6, the longitudinal axis A along gear tooth surface 108 is not perpendicular to the longitudinal axis B along the gripping surface 106 of adjustable jaw assembly 28. Instead, the two axes are offset by an angle X relative to a line C that would be perpendicular to axis B, where angle X is preferably between approximately one and approximately four degrees. In this way, gear teeth 54 are canted inward toward jaw 32 and offset from the gripping surface by approximately eighty-six to eighty-nine degrees instead of ninety degrees.

Referring to FIG. 3 and FIG. 5, gripping surfaces 104 and 106 are shown as including two sets of teeth as gripping members, a set of small teeth 110*a*, 110*b* and a set of large teeth 112*a*, 112*b*, similar to conventional pliers. Referring specifically to FIG. 5, however, note that the teeth 112*a* on jaw 14 do not directly oppose the teeth 112*b* on jaw 32. Instead, teeth 112*b* are laterally offset by an amount equal to approximately thirty percent of the distance between adjacent teeth 112*a*. As a result, when an object is gripped by jaws 14 and 32 it is less likely that teeth 112*a*, 112*b* will cut into the object. Instead, the object may simply undergo slight deformation in the area of contact with the teeth.

Figure 7:
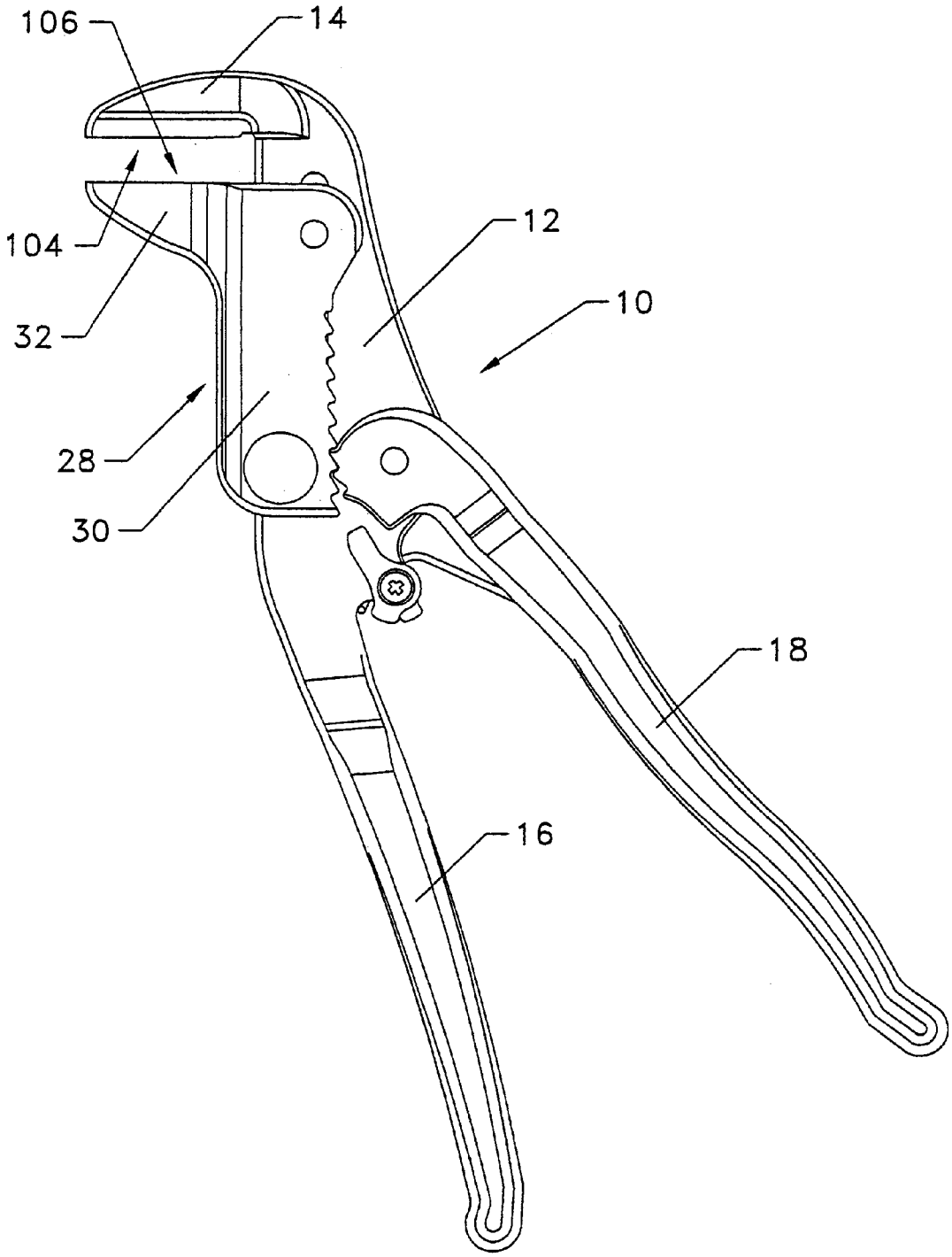
FIG. 7 is an assembled view in side elevation showing an alternative embodiment of the invention in the form of an adjustable wrench having jaws with smooth gripping surfaces.
Figure 8:
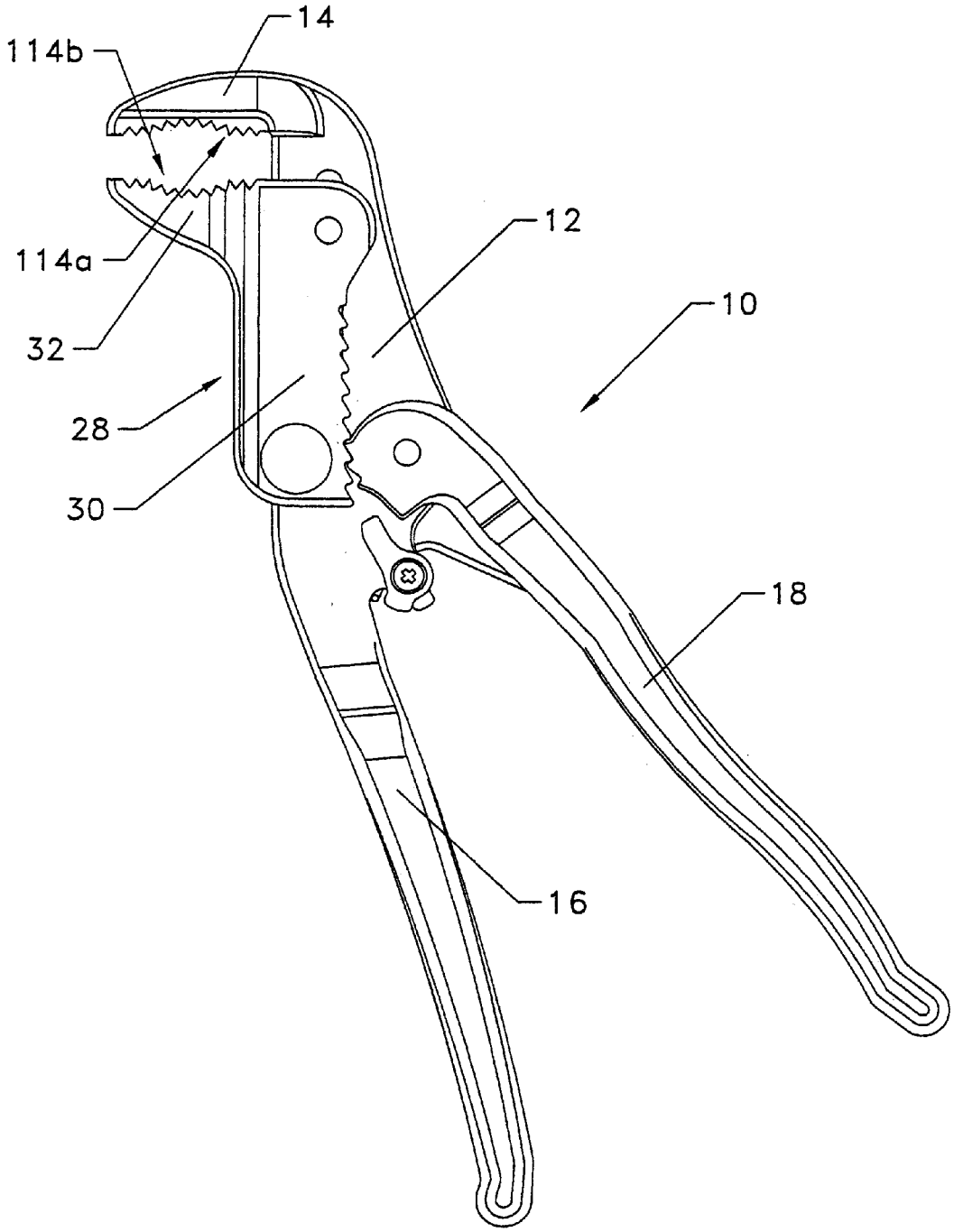
FIG. 8 is an assembled view in side elevation showing an alternative embodiment of the invention in form of an adjustable wrench having jaws with arcuately configured teeth for gripping cylindrical objects.

Referring now to FIG. 7, an alternative embodiment of the invention is shown where gripping surfaces 104, 106 do not include gripping members such as teeth but, instead, are smooth. This embodiment is particularly suited for use in turning nuts and bolts. FIG. 8 shows another embodiment of the invention where gripping surfaces 104, 106 include a large set of teeth 114*a*, 114*b* arranged arcuately in jaws 14 and 32. This is embodiment is particularly suited to gripping pipes, pipe connections, or other cylindrical-shaped objects.

Figure 9:
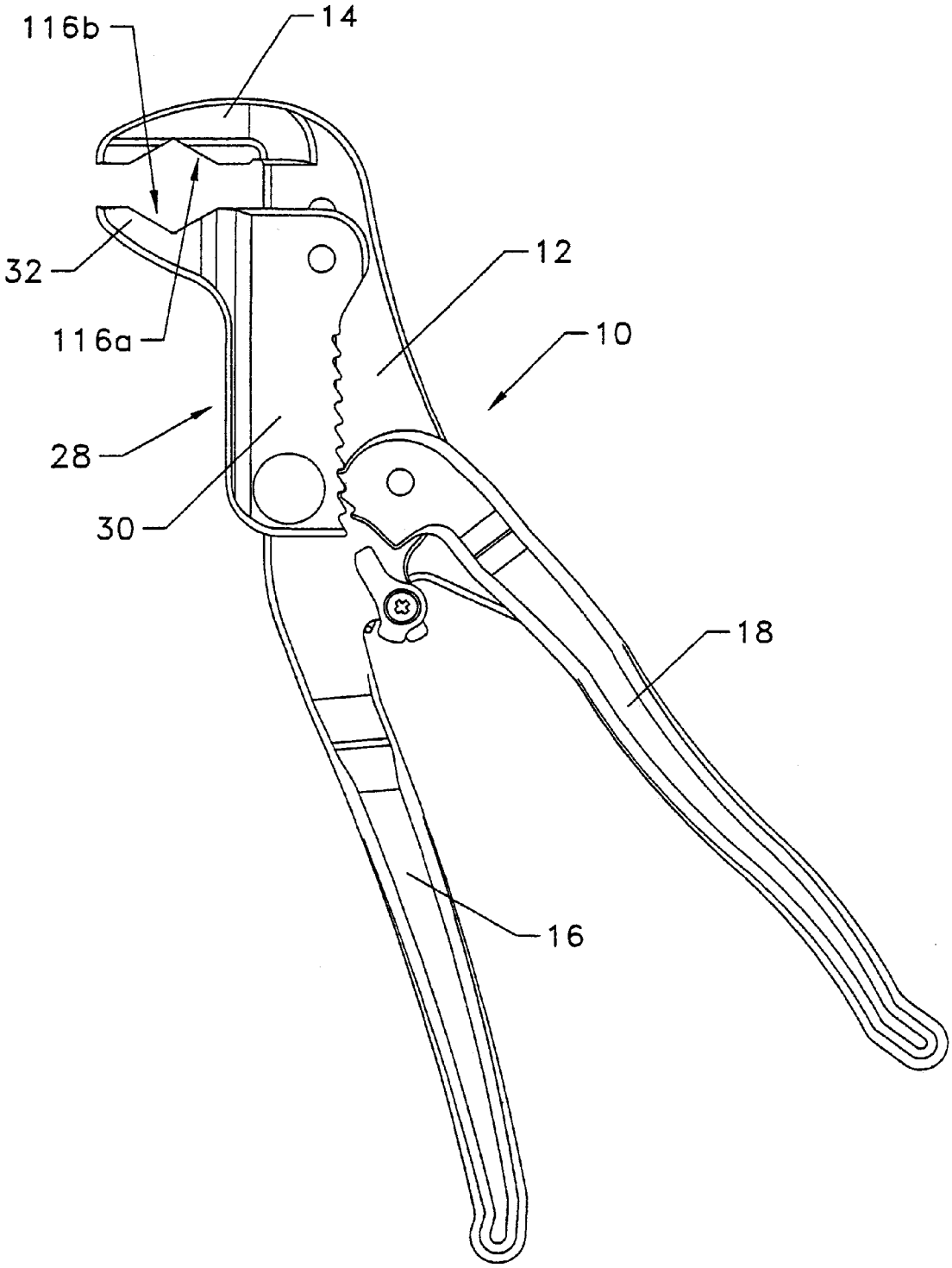
FIG. 9 is an assembled view in side elevation showing an alternative embodiment of the invention in the form of an adjustable wrench having jaws with opposing V-shaped gripping members.

FIG. 9 shows still another embodiment where gripping surfaces 104, 106 including opposing V's 116*a*, 116*b* with the corners having small radiused recesses to prevent the jaws from contacting the corners of hexagonal fittings, especially those made of materials that are softer than steel such as brass, copper, aluminum, and plastic. Those skilled in the art will appreciate that other jaw/gripping surface configurations could be employed for gripping objects of varied shapes.

Figure 10:
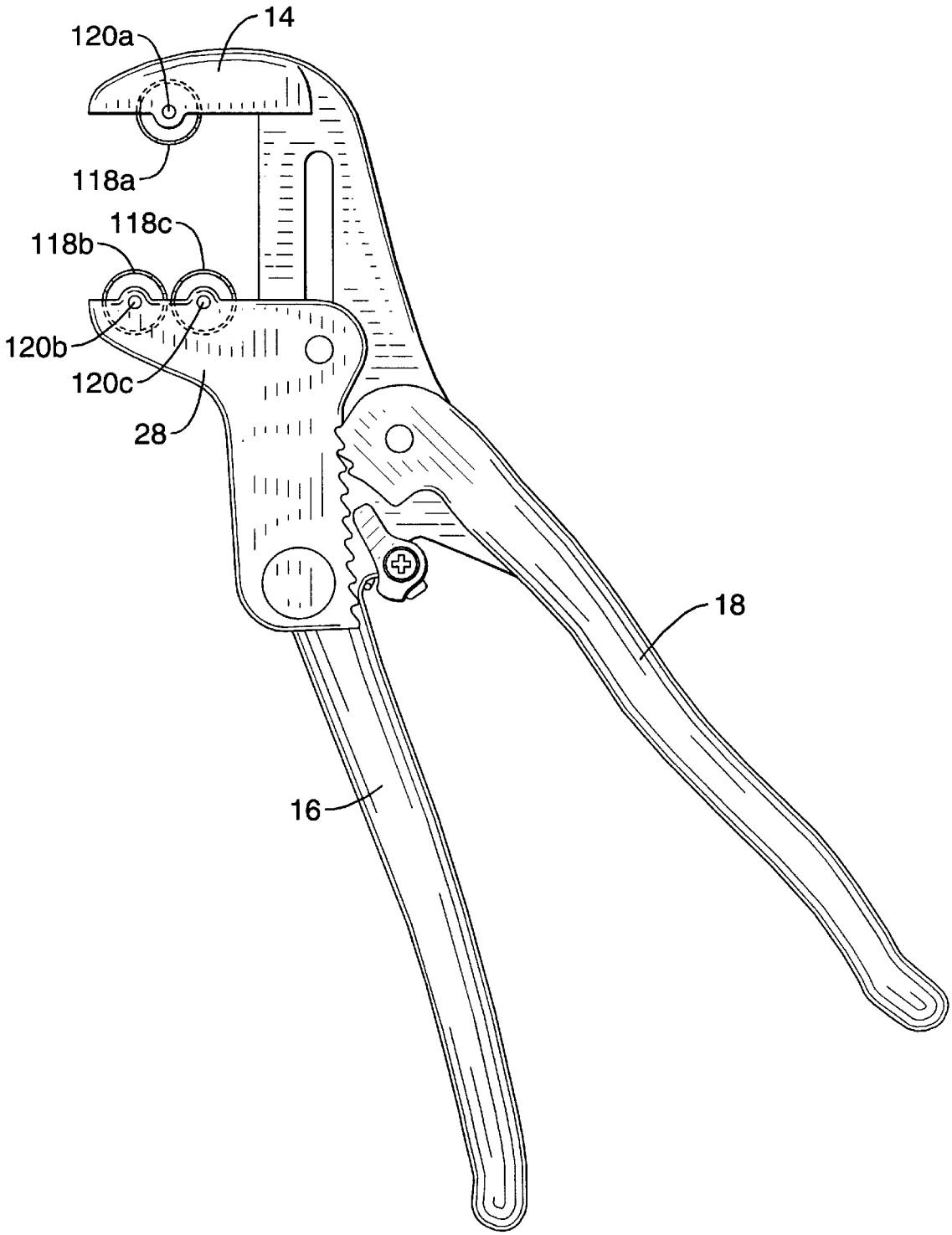
FIG. 10 is an assembled view in side elevation showing an alternative embodiment of the invention in the form of an adjustable pipe or rod cutter having jaws with opposing cutting disks configured to have two disks on the bottom jaw member and one disk on the top jaw member.
Figure 11:
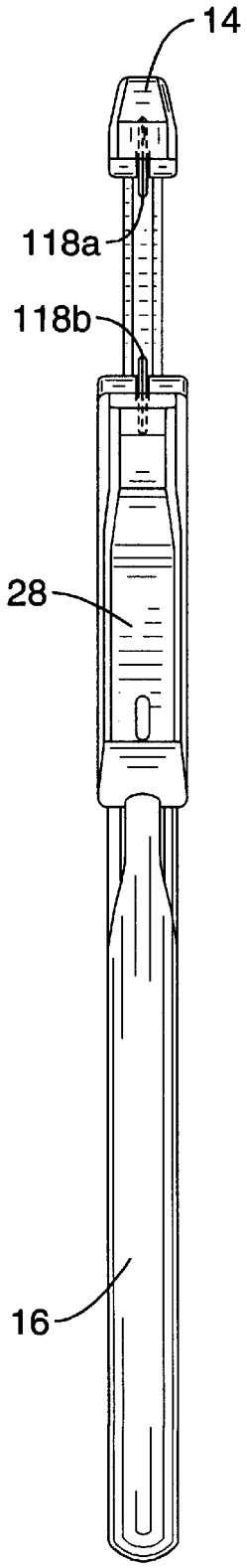
FIG. 11 is an assembled front view of the cutting apparatus shown in FIG. 10 with the jaws shown in the fully open position.

The jaws of the device can alternatively be fitted with rotary disks or horizontally oriented cutting blades as shown in FIG. 10 through FIG. 15 for cutting generally cylindrical or planar objects. Referring now to FIG. 10 and FIG. 11, an embodiment with cutting disks is shown. Jaw member 14 has a cutting disk 118*a* held in place by an axle 120*a* which allows cutting disk 118*a* to rotate freely about axle 120*a* as shown in FIG. 10. Lower or advancing jaw 28 has a pair of disks 118*b*, 118*c* which are secured to jaw 28 by axles 120*b*, 120*c*, respectively, such that disks 118*b*, 118*c* can rotate freely about the axles. As shown in FIG. 11, the cutting disks 118*a*, 118*b*, 118*c* are oriented in the same vertical plane. In use, the pipe or other object to be cut is placed between the disks 118*a*, 118*b* , and 118*c* in jaw members 14 and 28. The jaws advance until the disks engage the workpiece. The tool is then rotated about the pipe while pressure is maintained by the jaws allowing the cutting disks to cut incrementally through the pipe.

Figure 12:
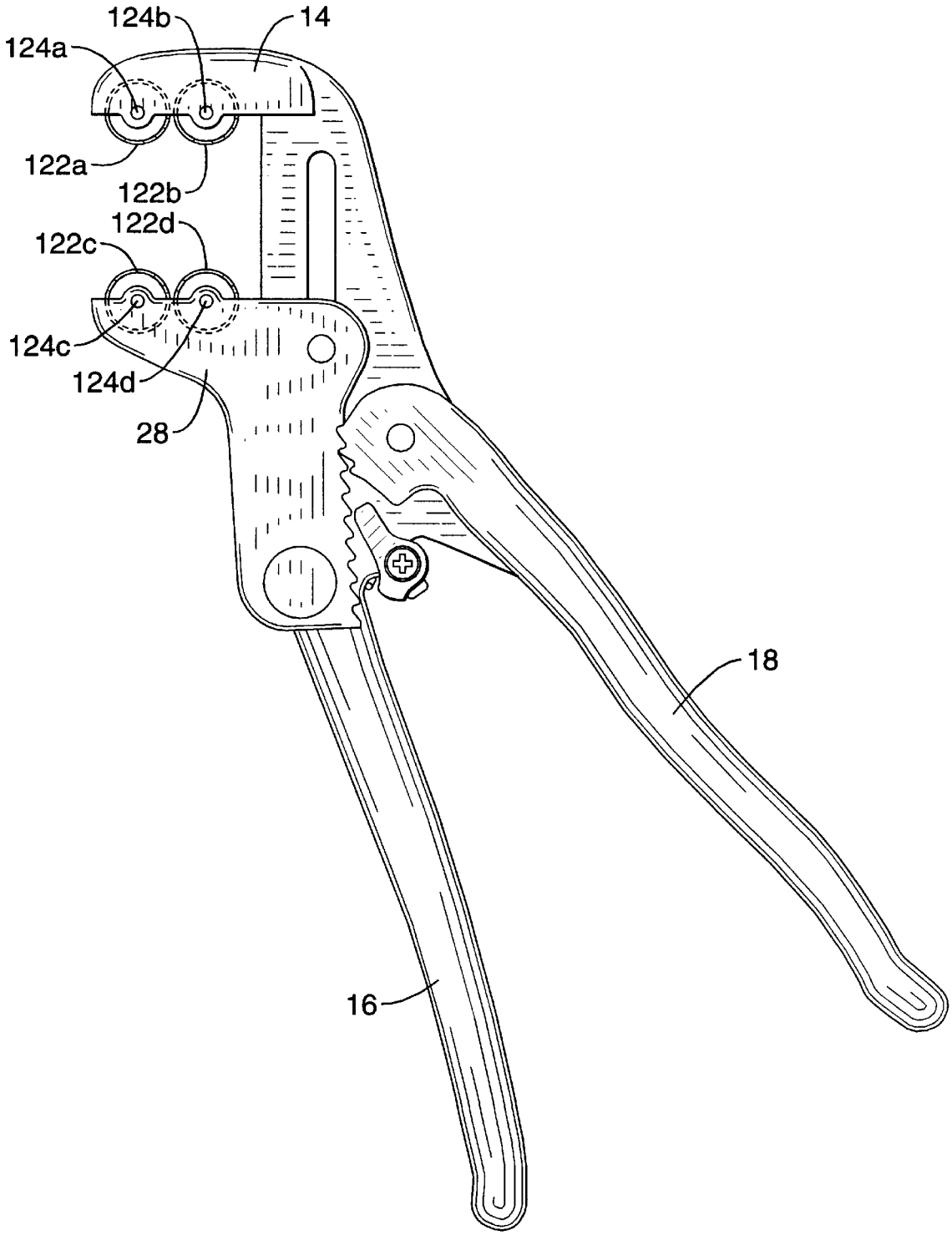
FIG. 12 is an assembled view in side elevation showing an alternative embodiment of the invention in the form of an adjustable pipe or rod cutter having jaws with opposing cutting disks configured to have two disks on the bottom jaw member and two disks on the top jaw member.

A second cutter embodiment with disks is shown in FIG. 12. Cutting disks 122*a*, 122*b* can rotate about axles 124*a*, 124*b* mounted in jaw member 14. Within jaw 28 are mounted cutting disks 122*c*, 122*d* which rotate about axles 124*c*, 124*d*, respectively. The disks 122*a*, 122*b* of jaw member 14 are preferably positioned directly above discs 122*c*, 122*d* of jaw member 32 within the same vertical plane.

While multiple cutting disks are preferred, it is understood that the tool could be configured with at least one cutting disk and one or more guide disks, rollers or other guide members (not shown) positioned within the same vertical plane as the cutting disk.

Figure 13:
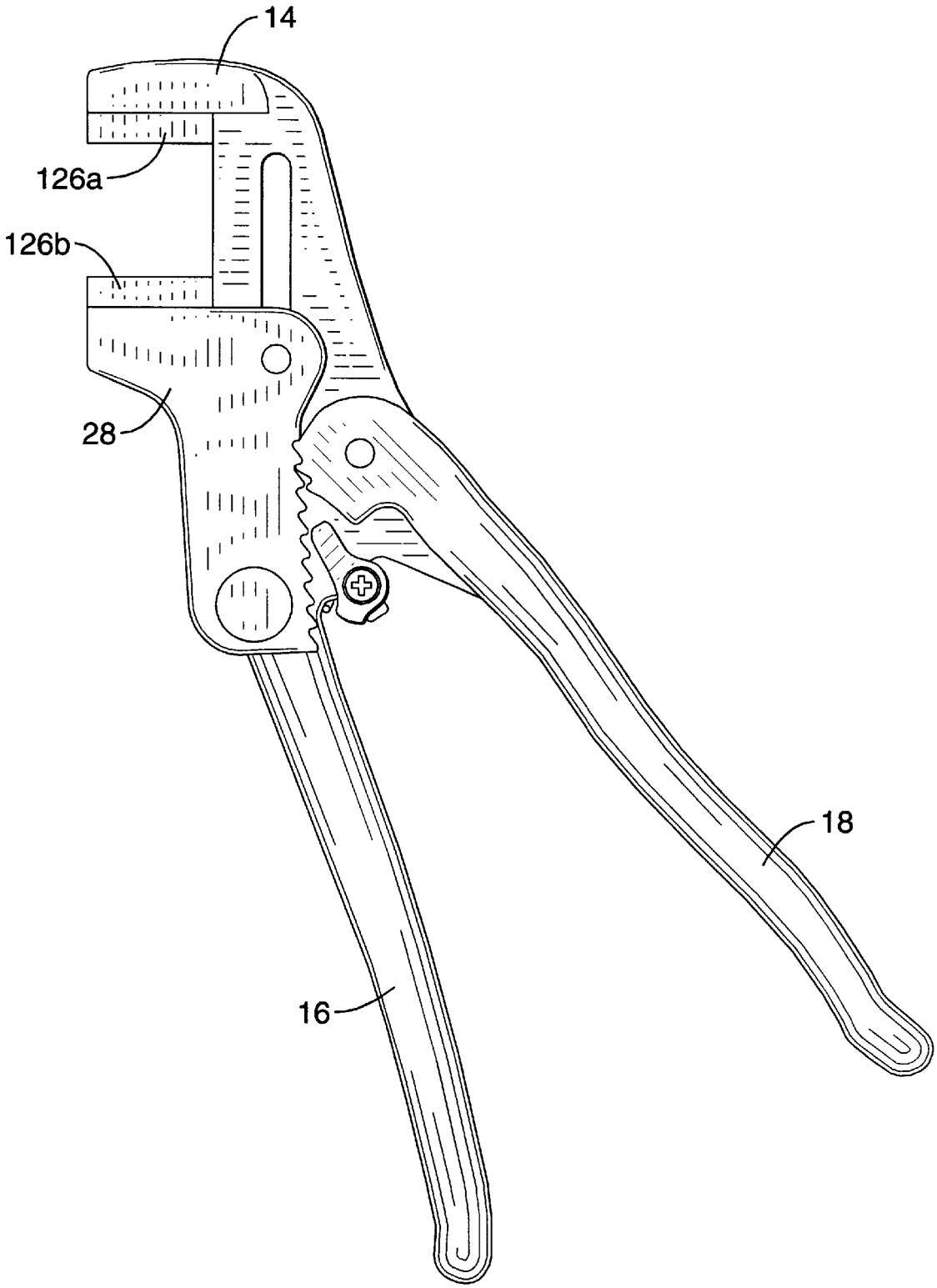
FIG. 13 is an assembled view in side elevation showing an alternative embodiment of the invention in the form of an adjustable bolt cutter having jaws with opposing blades with cutting edges disposed within the same vertical plane.
Figure 14:
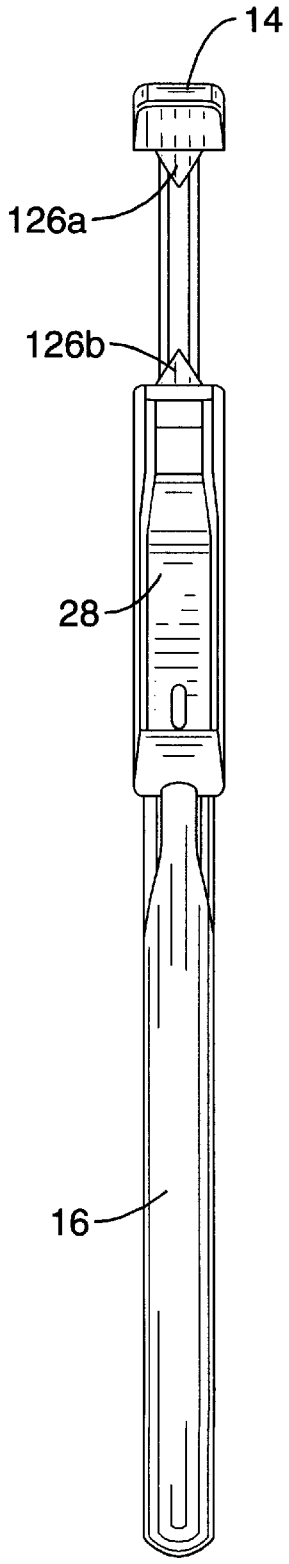
FIG. 14 is an assembled front view of the cutting apparatus shown in FIG. 13 with the cutting blades and jaws shown in the fully open position.

Turning now to the alternative embodiment found in FIG. 13 and FIG. 14, a pair of opposing fixed blades 126*a* and 126*b* are mounted on the horizontal inner surfaces of jaw 14 and opposing jaw 28, respectively. As can also be seen in FIG. 14, the horizontal blades 126*a* and 126*b* are preferably aligned in the same vertical plane such that the cutting edges of the blades are brought together when the jaws 14 and 28 are fully closed. This embodiment is useful for cutting metal sheets, nails, screws, bolts and the like.

Alternatively, the blades may be configured to lie in parallel vertical planes such that one side of blade 126*a* can engage the side of blade 126*b* when the jaws are fully closed (not shown).

Figure 15:
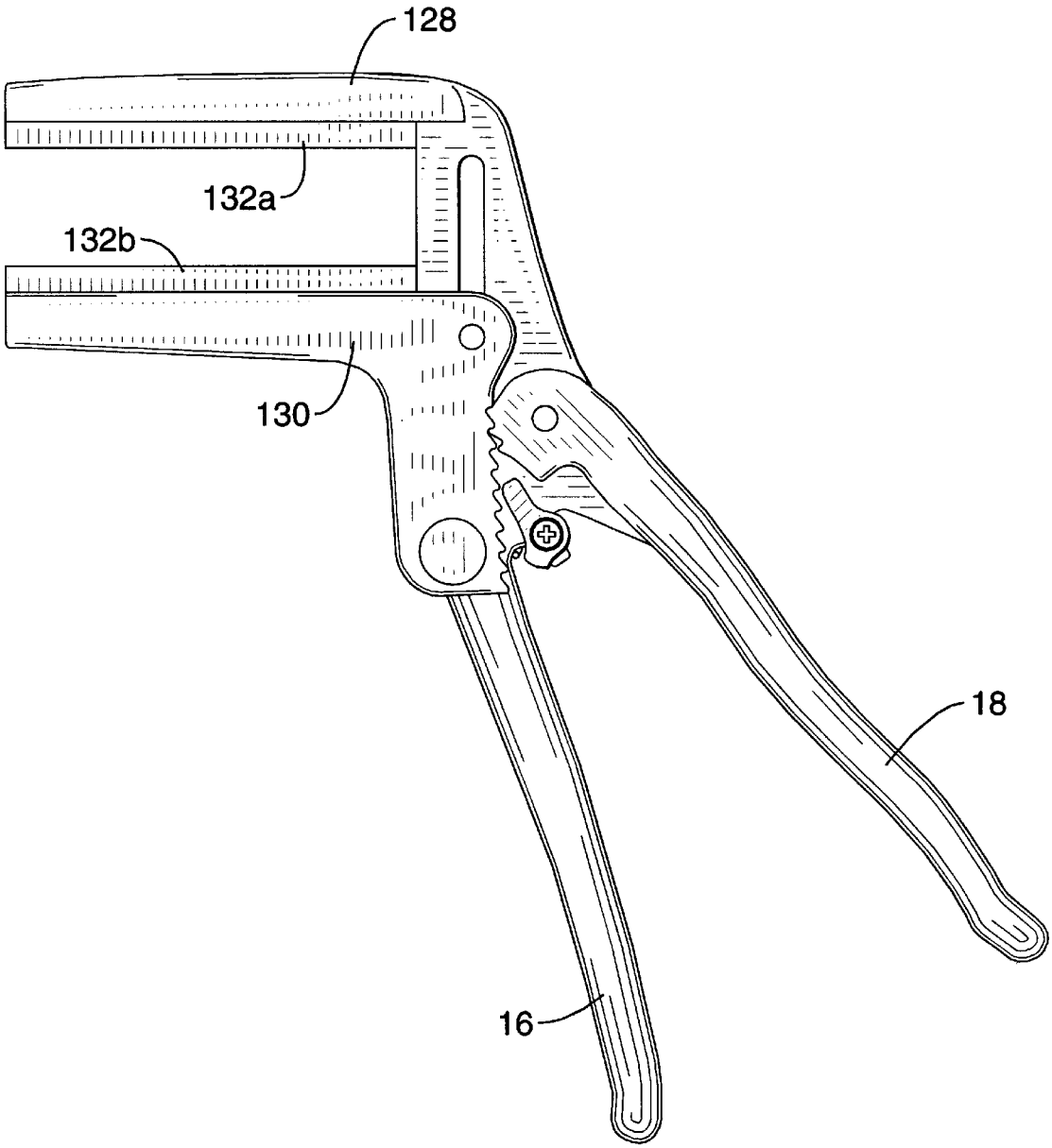

Finally, FIG. 15 is an alternative embodiment showing a fixed elongate jaw 128 and an adjustable jaw 130. Elongate blades 132*a*, 132*b*, which are similar to blades 126*a*, 126*b* described above, are mounted to jaws 128, 130, respectively. Blades 132*a* and 132*b* are preferably oriented within the same vertical plane so that the opposing blades are drawn together when jaws 128, 130 are closed. With this embodiment, a very straight cut in leather or like materials can be achieved without the material rolling across the blade as often occurs with conventional scissors or snips.

While it is preferred in the embodiments shown in FIG. 14 and FIG. 15 that blades 126*a*, 126*b* or blades 132*a*, 132*b* reside within the same vertical plane, it is understood that the blades may be aligned in adjacent vertical planes. Alternatively, the tool may be configured to have one or more blades on one jaw and a blade stop on the corresponding jaw (not shown). In this configuration, a single blade is driven through the workpiece when the jaws are brought together.

Accordingly, it will be seen that this invention provides a hand-operated tool that can quickly be adjusted to grip or cut a work object. Although the description above contains many specificities, these should not be construed as limiting the scope of the invention but as merely providing illustrations of some of the presently preferred embodiments of this invention. Thus the appended claims and their legal equivalents should determine the scope of this invention.

What is claimed is:

1. A cutting apparatus, comprising:

(a) a body, said body including a first handle, said body including a first jaw, said first jaw including a first cutting surface;

(b) a second handle, said second handle pivotally coupled to said body;

(c) a second jaw, said second jaw slidably and pivotally coupled to said body, said second jaw including a second cutting surface, said second jaw including a plurality of first gear teeth, said first gear teeth positioned along an axis that is canted toward said second cutting surface;

(d) a plurality of second gear teeth carried by said second handle, whereupon engagement of said second gear teeth of said second handle with said first gear teeth of said second jaw provides for adjusting said second jaw toward said first jaw; and (e) jaw opening means for adjusting said second jaw away from said first jaw.

2. An apparatus as recited in claim 1, wherein substantially parallel alignment between said first jaw and said second jaw is maintained during operation of said jaw closing means.

3. An apparatus as recited in claim 1, further comprising:

(a) a first elongate blade associated with said first cutting surface; and (b) a second elongate blade associated with said second cutting surface.

4. An apparatus as recited in claim 3, wherein said first elongate blade and said second elongate blade are oriented within the same vertical plane.

5. An apparatus as recited in claim 1, further comprising:

(a) a first cutting disk associated with said first cutting surface, said disk having a blade; and (b) a second cutting disk associated with said second cutting surface, said cutting disk having a blade.

6. An apparatus as recited in claim 6, wherein said first cutting disk is configured to rotate about a first axle and said second cutting disk is configured to rotate about a second axle.

7. An apparatus as recited in claim 1, further comprising:

(a) a first cutting disk associated with said first cutting surface, said disk having a blade; and (b) a pair of cutting disks associated with said second cutting surface, each of said cutting disks having a blade.

8. An apparatus as recited in claim 1, further comprising:

(a) a first pair of cutting disks associated with said first cutting surface, each of said disks having a blade; and (b) a second pair of cutting disks associated with said second cutting surface, each of said cutting disks having a blade.

9. A hand tool, comprising:

(a) a body, said body including an integrally formed fixed handle and an integrally formed fixed jaw, said fixed jaw including a first cutting surface;

(b) an adjustable jaw slidably and pivotally coupled to said body, said adjustable jaw including a second cutting surface, said adjustable jaw including a plurality of first gear teeth, said first gear teeth positioned along a longitudinal axis that is canted toward said second cutting surface;

(c) a jaw adjusting handle pivotally coupled to said body;

(d) a plurality of second gear teeth disposed on said jaw adjusting handle, whereupon engagement of said second gear teeth of said jaw adjusting handle and said first gear teeth of said adjustable jaw provides for adjusting said adjustable jaw toward said fixed jaw; and (e) jaw opening means for adjusting said adjustable jaw away from said fixed jaw.

10. A hand tool as recited in claim 9, wherein substantially parallel alignment between said fixed jaw and said adjustable jaw is maintained when said adjustable jaw is adjusted toward said fixed jaw.

11. A hand tool as recited in claim 9, further comprising:

(a) a first elongate blade associated with said first cutting surface; and (b) a second elongate blade associated with said second cutting surface.

12. An apparatus as recited in claim 9, further comprising:

(a) an elongate blade associated with said first cutting surface; and (b) a blade stop associated with said second cutting surface.

13. An apparatus as recited in claim 9, further comprising:

(a) a blade stop associated with said first cutting surface; and (b) an elongate blade associated with said second cutting surface.

14. An apparatus as recited in claim 11, wherein said first elongate blade and said second elongate blade are oriented within the same vertical plane.

15. An apparatus as recited in claim 9, further comprising:

(a) a first cutting disk associated with said first cutting surface, said disk having a blade; and (b) a plurality of guide members associated with said second cutting surface.

16. An apparatus as recited in claim 9, further comprising:

(a) a first cutting disk associated with said first cutting surface, said disk having a blade; and (b) a pair of cutting disks associated with said second cutting surface, each of said cutting disks having a blade.

17. An apparatus as recited in claim 9, further comprising:

(a) a first pair of cutting disks associated with said first cutting surface, each of said disks having a blade; and (b) a second pair of cutting disks associated with said second cutting surface, each of said cutting disks having a blade.

18. An apparatus as recited in claim 9, further comprising:

(a) a first cutting disk associated with said first cutting surface, said disk having a blade; and (b) a pair of guide members associated with said second cutting surface.

19. An apparatus as recited in claim 9, further comprising:

(a) a pair of cutting disks associated with said first cutting surface, each of said disks having a blade; and (b) a pair of guide members associated with said second cutting surface.

20. A hand tool, comprising:

(a) a body, said body including an integrally formed fixed handle and an integrally formed fixed jaw, said fixed jaw including a first cutting surface, said first cutting surface having a blade;

(b) a rail section formed on said body, said rail section being at substantially a 90-degree angle relative to said fixed jaw;

(c) an elongated slot in said body generally in parallel alignment with said rail section;

(d) an adjustable jaw, said adjustable jaw having a second cutting surface, said cutting surface having a blade;

(e) a bifurcated section on said adjustable jaw having side walls and an inner wall, said bifurcated section straddling said rail section;

(f) a fastener affixed to said side walls of said bifurcated section and inserted through said elongated slot, wherein said adjustable jaw is slidably and pivotally coupled to said body;

(g) a plurality of first gear teeth formed on said adjustable jaw, each of said first gear teeth having a long flat side and a short flat side joining at one end to form an angled tooth with a radiused edge, said first gear teeth positioned along an axis that is canted toward said second cutting surface;

(h) a jaw adjusting handle pivotally coupled to said body;

(i) a plurality of second gear teeth formed on said jaw adjusting handle, each of said second gear teeth having a long flat side and a short flat side joining at one end to form an angled tooth with a radiused edge, said second gear teeth cooperating with said first gear teeth on said adjustable jaw to slide said adjustable jaw toward said fixed jaw as said jaw adjusting handle is pivoted back and forth away from and toward said fixed handle, wherein substantially parallel alignment between said fixed jaw and said adjustable jaw is maintained during operation of said jaw adjusting handle;

(j) a spring having a lower and an upper end, said lower end coupled to said inner wall of said bifurcated section in said adjustable jaw, said spring being curved so that said upper end bears against said rail section and holds an upper portion of said second jaw away from said rail section and urges said first gear teeth on said second jaw toward second gear teeth on said jaw adjusting handle into engagement; and (k) at least one concave recess on said adjustable jaw that may be gripped to pull said bottom portion of said adjustable jaw away from said rail section on said body and separate said first gear teeth on said adjustable jaw from said second gear teeth on said jaw adjusting handle so that said adjustable jaw may be pulled away from said fixed jaw in one continuous motion.

* * * * *